US007425352B2

(12) United States Patent
Iwaki et al.

(10) Patent No.: US 7,425,352 B2
(45) Date of Patent: Sep. 16, 2008

(54) FLAMEPROOFING AGENT FOR POLYESTER-BASED TEXTILE PRODUCT AND METHOD OF FLAMEPROOFING

(75) Inventors: Terufumi Iwaki, Kyoto (JP); Katsuo Sasa, Kyoto (JP); Takeshi Masuda, Utazucho (JP)

(73) Assignee: Daikyo Chemical Co., Ltd., Kyoto (JP)

( * ) Notice: Subject to any disclaimer, the term of this patent is extended or adjusted under 35 U.S.C. 154(b) by 64 days.

(21) Appl. No.: 10/492,973

(22) PCT Filed: Oct. 15, 2002

(86) PCT No.: PCT/JP02/10688

§ 371 (c)(1),
(2), (4) Date: Apr. 16, 2004

(87) PCT Pub. No.: WO03/035965

PCT Pub. Date: May 1, 2003

(65) Prior Publication Data

US 2004/0249029 A1 Dec. 9, 2004

(30) Foreign Application Priority Data

Oct. 19, 2001 (JP) ..... 2001-322597

(51) Int. Cl.
*B05D 1/00* (2006.01)

(52) U.S. Cl. ..... 427/393.3; 427/394; 427/430.1

(58) Field of Classification Search ..... 427/389.9, 427/393.1, 393.2, 393.3, 393.4, 394, 430.1
See application file for complete search history.

(56) References Cited

U.S. PATENT DOCUMENTS

| | | | | | |
|---|---|---|---|---|---|
| 3,632,297 | A | * | 1/1972 | Sello | 8/183 |
| 3,764,374 | A | * | 10/1973 | Barton et al. | 427/394 |
| 3,997,699 | A | | 12/1976 | Sistrunk | |
| 5,118,843 | A | | 6/1992 | Hayashi et al. | |
| 5,478,648 | A | * | 12/1995 | Stein et al. | 428/375 |
| 6,228,912 | B1 | * | 5/2001 | Campbell et al. | 524/100 |

FOREIGN PATENT DOCUMENTS

| | | | |
|---|---|---|---|
| DE | 1091078 | | 10/1960 |
| GB | 867820 | * | 5/1961 |
| JP | 49-072346 | * | 7/1974 |

OTHER PUBLICATIONS

Abstracts and translation of CN 1155601 (Jul. 1997), and printout of RN 5756-03-6.*

* cited by examiner

*Primary Examiner*—Erma Cameron
(74) *Attorney, Agent, or Firm*—Wenderoth, Lind & Ponack, L.L.P.

(57) ABSTRACT

The invention provides a flame-retardant processing agent capable of imparting durable flame retardance to polyester-based fiber products without using halogen-based flame retardant. The flame-retardant processing agent is obtained by dispersing at least one phosphoric acid amide selected from the group consisting of 1,4-piperazinediyl bis(diarylphosphate), diaryl aminophosphate and aryl diaminophosphate as a flame retardant in a solvent in the presence of a nonionic surfactant or an anionic surfactant.

7 Claims, No Drawings

FLAMEPROOFING AGENT FOR POLYESTER-BASED TEXTILE PRODUCT AND METHOD OF FLAMEPROOFING

TECHNICAL FIELD

The present invention relates to flame-retardant processing or treatment of polyester-based fiber products. More particularly, the invention relates to a flame-retardant processing or treating agent capable of imparting durable flame retardance to polyester-based fiber products without using halogen-based flame retardant, to a flame-retardant processing method using the same, and to flame-retardant processed polyester-based fiber products obtained using the same.

BACKGROUND ART

A variety of methods for imparting flame retardance to polyester-based fiber products by post-processing have been hitherto known. For example, there is known a method of attaching, to polyester-based fiber products, a flame-retardant processing agent which is prepared by dispersing, with a dispersant in water, a halogen-containing compound, typically a brominated cycloalkane such as 1,2,5,6,9,10-hexabromocyclododecane as flame retardant (see, for example, Japanese Examined Patent Publication No. 53-8840 (1978)). However, by the method of imparting flame retardance to polyester-based fiber products by attaching halogen-containing compounds thereto will cause some problems: when such polyester-based fiber products burn, harmful halogenated gas is formed and this will exert harmful influence to the environment. Therefore, in recent years, use of such halogen-containing compounds as flame retardant has been restricted.

Under such circumstances, there have been made attempts to impart flame retardance to polyester-based fiber products by use of halogen-free phosphoric ester as flame retardant instead of those halogen-containing compounds. As such phosphoric esters, for example, aromatic monophosphates such as tricresyl phosphate and aromatic diphosphates such as resorcinol bis(diphenyl phosphate) are known. However, such phosphoric esters that have hitherto been known as flame retardant can impart polyester-based fiber products washing-resistant flame retardance, but are not sufficient in resistance to dry cleaning.

Moreover, even if a polyester-based fiber product is provided with flame retardance by using such a phosphoric ester, the phosphoric ester gradually moves to the surface of the polyester-based fiber product with time. During the movement, a dispersion dye and the like used for the dyeing of the polyester-based fiber product also move together with the phosphoric ester to the surface while being dissolved in the phosphoric ester to cause so-called "surface bleeding". Therefore, there arises a problem of reduction in color fastness.

The present inventors made study to solve the above-mentioned problems in the conventional flame-retardant processing of polyester-based fiber products. As a result, they found that use of some kind of phosphoric acid amide as flame retardant made it possible to impart durable flame retardance to polyester-based fiber products without using halogen-containing flame retardant.

Thus, the present inventors have reached the present invention. It is therefore an object of the present invention to provide a flame-retardant processing agent capable of imparting durable flame retardance to polyester-based fiber products, a flame-retardant processing method using the same, and to flame-retardant processed polyester-based fiber products obtained using the same.

DISCLOSURE OF THE INVENTION

The invention provides a flame-retardant processing agent for polyester-based fiber products, obtained by dispersing at least one phosphoric acid amide selected from the group consisting of (A) a 1,4-piperazinediyl bis(diarylphosphate) represented by formula (I):

(I)

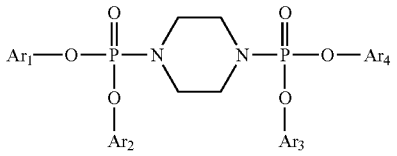

wherein $Ar_1$, $Ar_2$, $Ar_3$ and $Ar_4$ independently denote an aryl group, (B) a diaryl aminophosphate represented by formula (II):

(II)

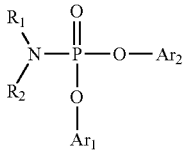

wherein $Ar_1$ and $Ar_2$ independently denote an aryl group, $R_1$ and $R_2$ independently denote a hydrogen atom, a lower alkyl group, a cycloalkyl group, an aryl group, an allyl group or an aralkyl group, or $R_1$ and $R_2$ may be combined together to form a ring, and (C) an aryl diaminophosphate represented by formula (III):

(III)

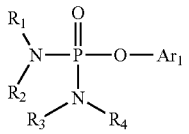

wherein $Ar_1$ denotes an aryl group, $R_1$, $R_2$, $R_3$ and $R_4$ independently denote a hydrogen atom, a lower alkyl group, a cycloalkyl group, an aryl group, an allyl group or an aralkyl group, or $R_1$ and $R_2$ may be combined together to form a ring, and $R_3$ and $R_4$ may be combined together to form a ring, in a solvent in the presence of at least one surfactant selected from the group consisting of nonionic surfactants and anionic surfactants.

The invention also provides a method for flame-retardant processing of a polyester-based fiber product, comprising flame-retardant treating a polyester-based fiber product with the above flame-retardant processing agent.

The present invention further provides a flame-retardant polyester-based fiber product obtained by treating a polyester-based fiber product with the above-mentioned flame-retardant processing agent.

BEST MODE FOR CARRYING OUT THE INVENTION

In the present invention, the "polyester-based fiber products" mean fiber containing at least polyester fiber therein, and yarn, cotton and cloth, such as woven fabric and non-woven fabric, containing such fiber. Preferably, the polyester-based fiber products mean polyester fiber, and yarn, cotton and cloth, such as woven fabric and non-woven fabric, formed of such fiber.

Examples of the polyester-based fiber may include, but are not limited to, fibers of polyethylene terephthalate, polypropylene terephthalate, polybutylene terephthalate, polyethylene naphthalate, polybutylene naphthalate, polyethylene terephthalate/isophthalate, polyethylene terephthalate/5-sodiosulfoisophthalate, polyethylene terephthalate/polyoxybenzoyl and polybutylene terephthalate/-isophthalate.

The polyester-based fiber products flame-retardant processed according to the invention are suitably employed as seats, seat covers, curtains, wallpaper, ceiling cloth, carpet, stage curtains, protective sheets for construction use, tents and sailclothes.

The agent of the invention for use in the flame-retardant processing of polyester-type fiber product is obtained by dispersing at least one phosphoric acid amide selected from the group consisting of (A) a 1,4-piperazinediyl bis(diarylphosphate) represented by formula (I):

(I)

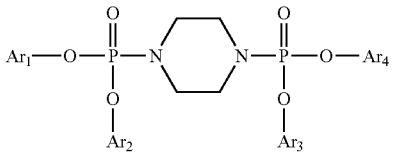

wherein $Ar_1$, $Ar_2$, $Ar_3$ and $Ar_4$ independently denote an aryl group, (B) a diaryl aminophosphate represented by formula (II):

(II)

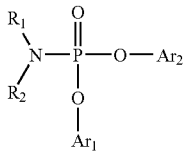

wherein $Ar_1$ and $Ar_2$ independently denote an aryl group, $R_1$ and $R_2$ independently denote a hydrogen atom, a lower alkyl group, a cycloalkyl group, an aryl group, an allyl group or an aralkyl group, or $R_1$ and $R_2$ may be combined together to form a ring, and (C) an aryl diaminophosphate represented by formula (III):

(III)

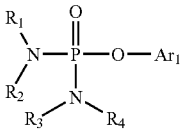

wherein $Ar_1$ denotes an aryl group, $R_1$, $R_2$, $R_3$ and $R_4$ independently denote a hydrogen atom, a lower alkyl group, a cycloalkyl group, an aryl group, an allyl group or an aralkyl group, or $R_1$ and $R_2$ may be combined together to form a ring, and $R_3$ and $R_4$ may be combined together to form a ring, in a solvent in the presence of at least one surfactant selected from the group consisting of nonionic surfactants and anionic surfactants.

In a first phosphoric acid amide represented by formula (I), i.e., 1,4-piperazinediyl bis(diarylphosphate), $Ar_1$, $Ar_2$, $Ar_3$ and $Ar_4$ independently denote an aryl group, preferably aryl groups having 6 to 18 carbon atoms. Examples of such aryl groups may include phenyl, naphthyl and biphenyl. In particular, phenyl is preferable. The aryl groups may have one or more, preferably one to three, lower alkyl group having 1 to 4 carbon atoms. Examples of such aryl groups having a lower alkyl group may include a tolyl group, a xylyl group and a methylnaphthyl group.

According to the invention, one of preferred example of the first phosphoric acid amide is 1,4-piperazinediyl bis(diphenyl-phosphate). For example, this 1,4-piperazinediyl bis (diphenyl-phosphate) can be obtained by reacting diphenyl phosphorochloridate with piperazine in a solvent in the presence of an amine catalyst as disclosed in Japanese Unexamined Patent Publication No. 10-175985 (1998).

In the second phosphoric acid amide represented by formula (II), i.e., diaryl aminophosphate, $Ar_1$ and $Ar_2$ independently denote an aryl group, preferably an aryl group having 6 to 18 carbon atoms. Examples of such aryl groups may include phenyl, naphthyl and biphenyl. In particular, phenyl is preferable. The aryl groups may have one or more, preferably one to three, lower alkyl group having 1 to 4 carbon atoms. Examples of such aryl groups having a lower alkyl group may include a tolyl group, a xylyl group and a methylnaphthyl group.

In the diaryl aminophosphate represented by formula (II), $R_1$ and $R_2$ independently denote a hydrogen atom, a lower alkyl group, a cycloalkyl group, an aryl group, an allyl group or an aralkyl group. Alternatively, $R_1$ and $R_2$ may be combined to form a ring together with the nitrogen atom attached to the phosphorus atom.

In formula (II), the lower alkyl group is preferably an alkyl group having from 1 to 4 carbon atoms, namely, methyl, ethyl, propyl or butyl. The alkyl groups having three or more carbon atoms may be either linear or branched. Examples of the cycloalkyl group may include cyclopentyl, cyclohexyl and cycloheptyl, with cyclohexyl being preferable. The aryl group is preferably an aryl group having 6 to 18 carbon atoms. Examples of such an aryl group may include phenyl, naphthyl and biphenyl, and in particular, phenyl is preferable. The aryl groups may have one or more, preferably one to three, lower alkyl groups having 1 to 4 carbon atoms. Examples of such aryl groups having a lower alkyl group may include a tolyl group, a xylyl group and a methylnaphthyl group. The aralkyl group is preferably benzyl or phenethyl. These may have on their phenyl groups one or more, preferably one to three, lower alkyl groups having 1 to 4 carbon atoms.

In formula (II), $R_1$ and $R_2$ may be combined together to form a ring together with the nitrogen atom attached to the phosphorus atom. In this case, the ring is generally preferably a six-membered ring. Examples of such a six-membered ring may include piperidyl, piperazinyl and morpholino.

Accordingly, preferred examples of the second phosphoric acid amide may include amino diphenyl phosphate, methylamino diphenyl phosphate, dimethylamino diphenyl phosphate, ethylamino diphenyl phosphate, diethylamino diphenyl phosphate, propylamino diphenyl phosphate, dipropylamino diphenyl phosphate, octylamino diphenyl phosphate, phosphate of diphenylundecylamine, cyclohexylamino diphenyl phosphate, dicyclohexylamino diphenyl phosphate, allylamino diphenyl phosphate, anilino diphenyl phosphate, di-o-cresylphenylamino phosphate, diphenyl (methylphenylamino) phosphate, diphenyl (ethylphenylamino) phosphate, benzylamino diphenyl phosphate and morpholino diphenyl phosphate.

Such diarylamino phosphates can be obtained by reacting an organic amine compound with a diaryl phosphorochloridate in an organic solvent in the presence of an amine catalyst as disclosed in Japanese Unexamined Patent Publication No. 2000-154277.

According to the invention, in particular, in the phosphoric acid amide represented by formula (II), $Ar_1$ and $Ar_2$ are preferably phenyl or tolyl. It is preferable that one of $R_1$ and $R_2$ be a hydrogen atom and the other be phenyl or cyclohexyl. Examples of such phosphoric acids may include anilino diphenyl phosphate, di-o-cresylphenylamino phosphate or cyclohexylamino diphenyl phosphate.

In the third phosphoric acid amide represented by formula (III), i.e., aryldiamino phosphate, $Ar_1$ is an aryl group, preferably an aryl group having 6 to 18 carbon atoms. Examples of such aryl groups may include phenyl, naphthyl and biphenyl. In particular, phenyl is preferable. The aryl groups may have one or more, preferably one to three, lower alkyl group having one to four carbon atoms. Examples of such aryl groups having a lower alkyl group may include a tolyl group, a xylyl group and a methylnaphthyl group.

In the aryldiamino phosphate represented by formula (III), $R_1$, $R_2$, $R_3$ and $R_4$ independently denote a hydrogen atom, a lower alkyl group, a cycloalkyl group, an aryl group, an allyl group or an aralkyl group. Alternatively, $R_1$ and $R_2$ may be combined together to form a ring together with the nitrogen atom attached to the phosphorus atom, and $R_3$ and $R_4$, likewise, may be combined together to form a ring together with the nitrogen atom attached to the phosphorus atom.

In formula (III), the lower alkyl group is preferably an alkyl group having from 1 to 4 carbon atoms, namely, methyl, ethyl, propyl or butyl. The alkyl groups having three or more carbon atoms may be either linear or branched. Examples of the cycloalkyl group may include cyclopentyl, cyclohexyl and cycloheptyl, and cyclohexyl is preferable. The aryl group is preferably an aryl group having 6 to 18 carbon atoms. Examples of such an aryl group may include phenyl, naphthyl and biphenyl, and among these phenyl is preferable. The aryl groups may have one or more, preferably one to three, lower alkyl group having 1 to 4 carbon atoms. Examples of such aryl group having a lower alkyl group may include a tolyl group, a xylyl group and a methylnaphthyl group. The aralkyl group is preferably benzyl or phenethyl. These may have on their phenyl groups a lower alkyl group having 1 to 4 carbon atoms.

Moreover, in formula (III), $R_1$ and $R_2$ may be combined together to form a ring together with the nitrogen atom attached to the phosphorus atom. In this case, the ring is generally preferably a six-membered ring. Examples of such a six-membered ring may include piperidyl, piperazinyl and morpholino. $R_3$ and $R_4$, likewise, may be combined together to form a ring together with the nitrogen atom attached to the phosphorus atom. In this case, the ring is generally preferably a six-membered ring. Examples of such a six-membered ring may include piperidyl, piperazinyl and morpholino. Either only one of the combination of $R_1$ and $R_2$ and the combination of $R_3$ and $R_4$ or both combinations may form a ring.

Accordingly, preferred examples of the third phosphoric acid amide may include diamino phenyl phosphate, aminomethyl amino phenyl phosphate, bis(methylamino) phenyl phosphate, amino ethylamino phenyl phosphate, bis(ethylamino) phenyl phosphate, amino propylamino phenyl phosphate, bis(propylamino) phenyl phosphate, amino octylamino phenyl phosphate, amino undecylamino phenyl phosphate, amino cyclohexylamino phenyl phosphate, biscyclohexylamino phenyl phosphate, bisarylamino phenyl phosphate, amino anilino phenyl phosphate, dianilino phenyl phosphate, anilino methylamino phenyl phosphate, ethylamino phenylamino phenyl phosphate, bisbenzylamino phenyl phosphate and dimorpholino phenyl phosphate.

Such aryl diamino phosphates can be obtained by reacting an organic amine compound with an aryl phosphorochloridate in an organic solvent in the presence of an amine catalyst as disclosed in Japanese Unexamined Patent Publication No. 2000-154277. Especially, according to the invention, in the phosphoric acid amide represented by formula (III), preferably employed is one in which $Ar_1$ is phenyl, one of $R_1$ and $R_2$ is a hydrogen atom and the other is phenyl or cyclohexyl. Specific examples of such a phosphoric acid amide may include biscyclohexylamino phenyl phosphate and dianilino phenyl phosphate.

The flame-retardant processing agent for polyester-based fiber products according to the invention is obtained by dispersing a phosphoric acid amide such as those described above as a flame retardant in a solvent in the presence of a surfactant. Water is generally used as the solvent. However, an organic solvent is also employed, if necessary.

As the surfactant, nonionic surfactants or anionic surfactants may be employed. Moreover, a nonionic surfactant and an anionic surfactant may be used in combination.

The flame-retardant processing agent according to the invention is preferably obtained by mixing the phosphoric acid amide with water together with the surfactant, and then milling the phosphoric acid amid into fine particles by use of a wet mill.

Examples of the nonionic surfactant may include polyoxyalkylene type nonionic surfactants such as alkylene oxide adducts of higher alcohol, alkylene oxide adducts of alkylphenol, alkylene oxide adducts of fatty acid, alkylene oxide adducts of fatty acid ester of polyhydric alcohol, alkylene oxide adducts of higher alkylamine and alkylene oxide adducts of fatty acid amide; and polyhydric alcohol type nonionic surfactants such as alkyl glycoxides and saccharide fatty acid esters.

On the other hand, examples of the anionic surfactant may include sulfuric ester salts such as higher alcohol sulfuric ester salts, higher alkyl ether sulfuric ester salts and sulfated fatty acid ester salts; sulfonic acid salts such as alkylbenzenesulfonic acid salts and alkylnaphthalenesulfonic acid salts; and phosphoric ester salts such as higher alcohol phosphoric ester salts and phosphoric ester salts of higher alcohol alkylene oxide adducts.

Examples of the organic solvent may include aromatic hydrocarbons such as toluene, xylene and alkylnaphthalene; ketones such as acetone and methyl ethyl ketone; ethers such as dioxane and ethyl cellosolve; amides such as dimethylformamide; sulfoxides such as dimethyl sulfoxide; and halogenated hydrocarbons such as methylene chloride and chloroform.

The surfactants and organic solvents may be used alone. Alternatively two or more surfactants or organic solvents may be used in combination, if necessary.

Generally, when fiber products are flame-retardant processed by post-processing, the particle diameter of the flame retardant to be used has an important effect on the flame-retardant performance imparted to the fiber products. Therefore, the smaller the particle diameter of the frame retardant, the higher the flame-retardant performance to be imparted to fiber products.

According to the invention, the particle diameter of the flame retardant usually ranges from 0.3 to 20 μm, preferably 0.3 to 3 μm so that durable flame-retardant performance can be achieved through a sufficient dispersion of the flame retardant inside polyester-based fiber products.

When the flame-retardant processing agent according to the invention is used in flame-retardant processing of polyester-based fiber products, it usually is used after being diluted in water. When being diluted in such a manner, the amount of the solid matter (phosphoric acid amide as flame retardant) in the flame-retardant processing agent preferably ranges from 1 to 50% by weight. The amount of flame-retardant processing agent attaching to a polyester-based fiber product vary depending on the kind of the fiber product, but usually ranges from 0.05 to 30% by weight, preferably 0.5 to 20% by weight as expressed in the amount of flame retardant (phosphoric acid amide). When the amount of the phosphoric acid amide in a flame-retardant processing agent attaching to a polyester-based fiber product is smaller than 0.05% by weight, it is impossible to impart sufficient flame retardance to the polyester-based fiber product. On the other hand, when it exceeds 30% by weight, some defective conditions will be caused; for example, feeling of fiber products after flame-retardant processing will get rough and hard.

The method for providing a polyester-based fiber product with the flame-retardant processing agent of the invention is not particularly limited. For example, according to one of the methods, the flame-retardant processing agent is attached to the polyester-based fiber product, and the fiber product is heat-treated at a temperature from 170 to 220° C. so that the fiber product takes in the frame retardant phosphoric acid amide into fibers by exhaustion. In this case, the flame-retardant processing agent can be attached to a polyester-based fiber product by, for example, padding, spraying or coating. According to another method, for example, the polyester-based fiber product is immersed in the flame-retardant processing agent in a bath, and is treated in the bath at a temperature from 110 to 140° C. so that the fiber product takes in the frame retardant thereinto by exhaustion.

Unless the performance is affected, the flame-retardant processing agent according to the invention may, if necessary, contain surfactants other than those described hereinabove as dispersing agent. Moreover, according to the invention, the flame-retardant processing agent may, if necessary, contain protective colloid agents for improving storage stability, such as polyvinyl alcohol, methyl cellulose, carboxymethyl cellulose or starch, flame-retardant aids for improving the flame retardance of the flame-retardant processing agent, ultraviolet absorbers or antioxidants for improving fastness to light. Furthermore, the flame-retardant processing agent may, if necessary, contain known flame retardants.

The flame-retardant processing agent according to the invention may be employed together with other fiber processing agents. Examples of such fiber processing agents may include fabric softeners, antistatic agents, water/oil repellents, hard finishing agents and feeling regulators.

INDUSTRIAL APPLICABILITY

As described above, the use of the flame-retardant processing agent of the invention makes it possible to impart highly-performable and durable flame retardance to various types of polyester-based fiber products without polluting the environment.

EXAMPLES

The invention will be described with reference to examples, but the invention is not limited to these examples. In the following description, the particle size distribution of phosphoric acid amide in a flame-retardant processing agent was measured using a laser diffraction particle size analyzer SALD-2000J manufactured by Shimadzu Corp. and the median diameter was taken as the average particle diameter.

Example 1

Production of Flame-Retardant Processing Agent A

Into a 2-L separable flask, 600 mL of dichloroethane, 212.3 g of triethylamine and 139.7 g of aniline were placed. 403.0 g of diphenylphosphorochloride was dropped to the mixture over 20 minutes while being cooled with water and being stirred. After the completion of the dropping, the stirring was continued at a liquid temperature of 60° C. for six hours. The resulting precipitate was collected by filktration, washed with water, and then dried to yield 383 g of anilino diphenyl phosphate.

40 parts by weight of this anilino diphenyl phosphate, 3.5 parts by weight of sodium dioctylsulfosuccinate and 0.1 part by weight of silicone-based antifoaming agent were mixed with 25 parts by weight of water. The mixture was charged in a mill containing glass beads of 0.8 mm in diameter and was milled until the phosphoric acid amide had an average particle diameter of 0.526 μm. The milled matter was conditioned so that it had a concentration of nonvolatile components of 40% by weight by drying at a temperature of 105° C. for 30 minutes, thereby providing a flame-retardant processing agent A according to the invention.

Example 2

Production of Flame-Retardant Processing Agent B 40 parts by weight of the anilino diphenyl phosphate prepared in Example 1, 3.5 parts by weight of nonylphenol ethylene oxide 9-mole adduct, 0.5 part by weight of sodium dodecyl phenyl ether sulfonate and 0.1 part by weight of silicone-based antifoaming agent were mixed with 25 parts by weight of water. The mixture was charged in a mill containing glass beads of 0.8 mm in diameter and was milled until the phosphoric acid amide had an average particle diameter of 0.603 μm. The milled matter was conditioned so that it had a concentration of nonvolatile components of 40% by weight by drying at a temperature of 105° C. for 30 minutes, thereby providing a flame-retardant processing agent B according to the invention.

Example 3

Production of Flame-Retardant Processing Agent C

Into a 2-L separable flask, 200 mL of dichloroethane and 79.3 g of cyclohexylamine were placed. 42.2 g of phenylphosphorochloride was dropped to the mixture slowly while cooling with water and stirring After the completion of the dropping, the stirring was continued at a liquid temperature of 60° C. for two hours. The resulting precipitate was collected by filtration, washed with water, and then dried to yield 55.8 g of biscyclohexylaminophenyl phosphate.

40 parts by weight of this biscyclohexylaminophenyl phosphate, 3.5 parts by weight of sodium dodecyldiphenyl ether sulfonate and 0.1 part by weight of silicone-based antifoaming agent were mixed with 25 parts by weight of water. The mixture was charged in a mill containing glass beads of 0.8 mm in diameter and was milled until the phosphoric acid amide had an average particle diameter of 0.556 μm. The milled matter was conditioned so that it had a concentration of nonvolatile components of 40% by weight by drying at a temperature of 105° C. for 30 minutes, thereby providing a flame-retardant processing agent C according to the invention.

Example 4

Production of Flame-Retardant Processing Agent D

Into a 2-L separable flask, 1000 mL of 1,4-dioxane, 80.8 g of triethylamine and 34.4 g of piperazine were placed. 214.8 g of diphenylphosphorochloride was dropped slowly while cooling with water and stirring. After the completion of the dropping, the stirring was continued at a liquid temperature of 60° C. for four hours. The resulting reaction mixture was cooled and then transferred into a 5-L beaker, to which 3 L of water was then added. The resulting precipitate was collected by filtration, washed with water, and then dried to yield 212 g of 1,4-piperazinediyl bis(diphenylphosphate).

40 parts by weight of this 1,4-piperazinediyl bis(diphenylphosphate), 3.5 parts by weight of sodium dioctylsulfosuccinate and 0.1 part by weight of silicone-based antifoaming agent were mixed with 25 parts by weight of water. The mixture was charged in a mill containing glass beads of 0.8 mm in diameter and was milled until the phosphoric acid amide had an average particle diameter of 0.522 μm. The milled matter was conditioned so that it had a concentration of nonvolatile components of 40% by weight by drying at a temperature of 105° C. for 30 minutes, thereby providing a flame-retardant processing agent D according to the invention.

Example 5

Production of Flame-Retardant Processing Agent E

Into a flask provided with a stirrer, a thermometer, a reflux cooling tube and a dropping funnel, 354 g of triethylamine, 182.5 g of diethylamine and 2 L of dichloroethane were placed. Then, 671.5 g of diphenylphosphorochloride was dropped over 30 minutes while cooling and stirring so that the internal temperature was kept under 50° C. Thereafter, the stirring was continued at room temperature for three hours. Then, the internal temperature was further raised to 85° C. and stirring was made for another one hour. The resulting reaction mixture was cooled and the precipitate formed was collected by filtration, washed with water and dried, thereby providing 610 g (yield 80%) of diphenyl diethylamino phosphate in the form of white powdery crystals having a melting point of 51 to 53° C.

40 parts by weight of the diphenyl diethylamino phosphate, 3.5 parts by weight of sodium dodecyldiphenyl ether sulfonate and 0.1 part by weight of silicone-based antifoaming agent were mixed with 25 parts by weight of water. The mixture was charged in a mill containing glass beads of 0.8 mm in diameter and was milled until the phosphoric acid amide had an average particle diameter of 0.747 μm. The milled matter was conditioned so that it had a concentration of nonvolatile components of 40% by weight by drying at a temperature of 105° C. for 30 minutes, thereby providing a flame-retardant processing agent E according to the invention.

Example 6

Production of Flame-Retardant Processing Agent F

To a dichloroethane (2 L) solution containing 93.1 g of aniline and 120 g of triethylamine, 296.7 g of di-o-cresylphosphoryl chloride obtainable by reacting phosphorus oxychloride and o-cresol by a conventional method was dropped over three hours while cooling with water and stirring. After the completion of the dropping, the resulting precipitate was collected by filtration, washed with water and dried, thereby providing 282 g (yield 80%) of di-o-cresylphenylamino phosphate was obtained in the form of white powdery crystals having a melting point of 127 to 129° C.

40 parts by weight of the di-o-cresylphenylamino phosphate, 3.5 parts by weight of sodium dioctylsulfosuccinate and 0.1 part by weight of silicone-based antifoaming agent were mixed with 25 parts by weight of water. The mixture was charged in a mill containing glass beads of 0.5 mm in diameter and was milled until the phosphoric acid amide had an average particle diameter of 0.339 μm. The milled matter was conditioned so that it had a concentration of nonvolatile components of 40% by weight by drying at a temperature of 105° C. for 30 minutes, thereby providing a flame-retardant processing agent F according to the invention.

Example 7

Production of Flame-Retardant Processing Agent G

To a dichloroethane (2 L) solution containing 232.5 g of aniline and 252.5 g of triethylamine, 210 g of phenylphosphorochloride obtained by reacting phosphorus oxychloride and phenol in an equivalent molar ratio by a conventional method was dropped over three hours while cooling with water and stirring. After the completion of the dropping, the resulting precipitate was collected by filtration, washed with water and dried, thereby providing 237 g (yield 73%) of dianilino phenyl phosphate in the form of white powdery crystals having a melting point of 176 to 178° C.

40 parts by weight of this dianilino phenyl phosphate, 3.5 parts by weight of sodium dodecyldiphenyl ether sulfonate and 0.1 part by weight of silicone-based antifoaming agent were mixed with 25 parts by weight of water. The mixture was charged in a mill containing glass beads of 0.8 mm in diameter and was milled until the phosphoric acid amide had an average particle diameter of 0.551 μm. The milled matter was conditioned so that it had a concentration of nonvolatile components became 40% by weight by drying at a temperature of 105° C. for 30 minutes, thereby providing a flame-retardant processing agent G according to the invention.

Comparative Example 1

Production of Flame-Retardant Processing Agent H 40 parts by weight of frame retardant 1,2,5,6,9,10-hexabromocyclododecane, 3.5 parts by weight of sodium dioctylsulfosuccinate and 0.1 part by weight of silicone-based antifoaming agent were mixed with 25 parts by weight of water. The mixture was charged in a mill containing glass beads of 0.8 mm in diameter and was milled until the flame retardant had an average particle diameter of 0.415 μm. The milled matter was conditioned so that it had a concentration of nonvolatile components of 40% by weight by drying at a temperature of 105° C. for 30 minutes, thereby providing a flame-retardant processing agent H as a comparative example.

Comparative Example 2

Production of Flame-Retardant Processing Agent I

In 50 parts by weight of water, 40 parts by weight of flame-retardant, tetraphenyl-m-phenylene phosphate, was emulsified and dispersed together with silicone-based anti-foaming agent by use of 3.5 parts by weight of sorbitan monostearate ethylene oxide 20-mole adduct as an emulsifier. The dispersion was conditioned so that it had a concentration of nonvolatile components of 40% by weight by drying at a temperature of 105° C. for 30 minutes, thereby providing a flame-retardant processing agent I as a further comparative example. The flame retardant in the flame-retardant processing agent had an average particle diameter of 6.476 μm.

Example 8 and Comparative Example 3

Using the flame-retardant processing agents A to G according to the invention and the flame-retardant processing agents H and I as the comparative examples, clothes (Polyester Tropical (weight per unit area of 140 g/m$^2$) were treated to yield flame-retardant processed polyester-based fiber products according to the present invention and polyester-based fiber products as comparative examples. For these products, the results of flame retardant performance tests are shown in Tables 1 and 2.

(Test Method)

In each dye bath, 3% owf of dispersion dye, 0.5 g/L of dye dispersant (anionic dispersant) and 15% owf of flame-retardant processing agent according to the invention or that as the comparative example were compounded and the pH was adjusted to 4.6 to 4.8 by acetic acid. The bath ratio was adjusted to 1:15.

A cloth was put into a dye bath and the bath was heated from 50° C. to 130° C. at a rate of 2° C./minute, then held at 130° C. for 60 minutes so that it was treated by exhaustion method in the bath. The cloth was then washed with water, dried and subjected to heat treatment at 180° C. for one minute. Thereafter, it was evaluated for flame retardant performance according to the JIS L 1091 D method (Coil method, when the number of flame touches is three or more, the sample is judged as passing).

(Washing with Water)

Five cycles of treatment were conducted where one cycle was composed, according to JIS K 3371, of washing in water at a bath ratio of 1:40 at 60±2° C. for 15 minutes using a weak alkaline class 1 detergent in an amount of 1 g/L, repeating three times a five-minute rinsing at 40±2° C., conducting centrifugal dehydration for two minutes, and then hot air drying at 60±5° C.

(Dry Cleaning)

For 1 g of sample, six cycles of treatment were conducted where one cycle was composed of cleaning at 30±2° C. for 15 minutes using 12.6 mL of tetrachloroethylene and 0.265 g of charge soap (weight composition of the charge soap: nonionic surfactant/anionic surfactant/water=10/10/1).

(Color Fastness)

The test was conducted by the test method for color fastness to water, B method, provided in JIS L 0846. Judgment was made using a gray scale for stain.

(Fastness to Rubbing)

The test was conducted by the test method for color fastness to rubbing provided in JIS L 0849. Judgement was made using a gray scale for stain.

(Fastness to Light)

According to JIS L 0842, judgement was made using a gray scale for change in color, at 63° C. after 40 hours and 80 hours.

TABLE 1

| | | Example 8 | | | | |
|---|---|---|---|---|---|---|
| Flame-retardant processing agent | | A | B | C | D | E |
| Nonvolatile content (% by weight) | | 40 | 40 | 40 | 40 | 40 |
| Flame retardant content (% by weight) | | 36.8 | 36.4 | 36.8 | 36.8 | 36.8 |
| Average particle diameter of flame retardant (μm) | | 0.526 | 0.603 | 0.556 | 0.522 | 0.747 |
| Flame-retardant processing | | | | | | |
| Amount of flame-retardant processing agent added (% owf) | | 15 | 15 | 15 | 15 | 15 |
| Flame retardant-treated cloth | | | | | | |
| Amount of attaching flame retardant (% owf) | | 2.7 | 2.1 | 2.0 | 2.0 | 2.3 |
| Feeling | | Good | Good | Good | Good | Good |
| Color fastness | | | | | | |
| Cotton | 1 hour | Class 5 | Class 4 | Class 4-5 | Class 4-5 | Class 4 |
| | 16 hour | Class 4-5 | Class 4 | Class 4 | Class 4 | Class 4 |
| Polyester | 1 hour | Class 5 | Class 4-5 | Class 5 | Class 5 | Class 4 |
| | 16 hour | Class 4 | Class 4 | Class 4-5 | Class 4 | Class 4 |
| Fastness to rubbing | | | | | | |
| Dry test | | Class 4 | Class 4 | Class 4 | Class 4 | Class 4 |
| Wet test | | Class 4-5 | Class 4 | Class 4 | Class 4 | Class 4 |
| Fastness to light (63° C.) | | | | | | |
| 40 hours | | Class 4-5 | Class 4 | Class 5 | Class 4 | Class 4 |
| 80 hours | | Class 4 | Class 4 | Class 4-5 | Class 4 | Class 4 |

TABLE 1-continued

| | Example 8 | | | | |
|---|---|---|---|---|---|
| Flame retardant performance (number of flame touches (n = 5)) | | | | | |
| Initial | 4, 5, 5, 4, 4 | 5, 5, 4, 4, 4 | 3, 4, 4, 4, 4 | 4, 4, 4, 4, 4 | 3, 3, 4, 3, 4 |
| After washing | 4, 4, 5, 5, 4 | 5, 5, 5, 4, 4 | 4, 5, 4, 4, 5 | 5, 4, 4, 5, 5 | 4, 4, 4, 3, 4 |
| After dry cleaning | 5, 4, 4, 4, 4 | 4, 4, 4, 3, 3 | 3, 4, 4, 4, 4 | 4, 3, 3, 3, 4 | 3, 3, 3, 3, 3 |

TABLE 2

| | Example 8 | | Comparative Example 3 | |
|---|---|---|---|---|
| Flame-retardant processing agent | F | G | H | I |
| Nonvolatile content (% by weight) | 40 | 40 | 40 | 40 |
| Flame retardant content (% by weight) | 36.8 | 36.8 | 36.8 | 36.8 |
| Average particle diameter of flame retardant (μm) | 0.339 | 0.551 | 0.415 | 6.476 |
| Flame-retardant processing | | | | |
| Amount of flame-retardant processing agent added (% owf) | 15 | 15 | 15 | 15 |
| Flame retardant-treated cloth | | | | |
| Amount of attaching flame retardant (% owf) | 2.8 | 2.1 | 2.7 | 4.1 |
| Feeling | Good | Good | Good | Slipping |
| Color fastness | | | | |
| Cotton 1 hour | Class 5 | Class 5 | Class 4-5 | Class 4 |
| 16 hour | Class 5 | Class 4-5 | Class 4 | Class 3 |
| Polyester 1 hour | Class 5 | Class 5 | Class 5 | Class 4 |
| l6hour | Class 4-5 | Class 4 | Class 4 | Class 3-4 |
| Fastness to rubbing | | | | |
| Dry test | Class 4 | Class 4 | Class 4 | Class 1 |
| Wet test | Class 4-5 | Class 4-5 | Class 4-5 | Class 1-2 |
| Fastness to light (63° C.) | | | | |
| 40 hours | Class 4 | Class 4 | Class 4 | Class 3 |
| 80 hours | Class 4 | Class 3-4 | Class 3 | Class 2 |
| Flame retardant performance (number of flame touches (n = 5)) | | | | |
| Initial | 5, 5, 4, 4, 4 | 3, 4, 3, 4, 4 | 5, 4, 4, 4, 4 | 3, 4, 4, 3, 3 |
| After washing | 5, 5, 5, 4, 5 | 4, 4, 5, 4, 3 | 5, 5, 5, 5, 4 | 5, 4, 4, 4, 3 |
| After dry cleaning | 4, 4, 4, 4, 4 | 3, 4, 3, 3, 4 | 3, 4, 4, 4, 4 | 3, 2, 3, 2, 1 |

Example 9 and Comparative Example 4

A cloth was put, in advance, in a dye bath having a bath ratio of 1:15, 3% owf of dispersion dye, 0.5 g/L of dye dispersant (anionic dispersant) and a pH of 4.6 to 4.8 adjusted by acetic acid. The bath was heated from 50° C. to 130° C. at a rate of 2° C./minute, then held at 130° C. for 60 minutes to subject the cloth to dyeing treatment. The cloth was washed with water, dried and then subjected to heat treatment at 180° C. for one minute to yield a cloth to be treated.

A flame-retardant processing agent having a solid content of 150 g/L of flame-retardant according to the invention and a flame-retardant processing agent having a solid content of 150 g/L of flame-retardant as the comparative example were prepared. Using each of these flame-retardant processing agents, the cloth was subjected to padding treatment, dried at 100° C. for three minutes, subjected to heat treatment at 180° C. for one minute, and washed with hot water at 80° C. After drying, the cloth was subjected to heat treatment at 180° C. for one minute and then evaluated for flame retardant performance according to JIS L 1091, D method. Washing and dry cleaning were conducted in the same manners as described hereinbefore. The color fastness, fastness to rubbing and fastness to light were judged in the same manners as described hereinbefore. The results are shown in Tables 3 and 4.

TABLE 3

| | Example 9 | | | | |
|---|---|---|---|---|---|
| Flame-retardant processing agent | A | B | C | D | E |
| Nonvolatile content (% by weight) | 40 | 40 | 40 | 40 | 40 |
| Flame retardant content (% by weight) | 36.8 | 36.4 | 36.8 | 36.8 | 36.8 |
| Average particle diameter of flame retardant (μm) | 0.526 | 0.603 | 0.556 | 0.522 | 0.747 |
| Flame-retardant processing | | | | | |
| Amount of flame-retardant processing agent added (g/L) | 150 | 150 | 150 | 150 | 150 |
| Squeezing ratio (% owf) | 87.8 | 84.8 | 82.8 | 84.8 | 83.1 |

TABLE 3-continued

| | | Example 9 | | | | |
|---|---|---|---|---|---|---|
| Flame retardant-treated cloth | | | | | | |
| Amount of attaching flame retardant (% owf) | | 2.3 | 2.1 | 1.9 | 2.4 | 2.5 |
| Feeling | | Good | Good | Good | Good | Good |
| Color fastness | | | | | | |
| Cotton | 1 hour | Class 5 | Class 4-5 | Class 4-5 | Class 4-5 | Class 4 |
| | 16 hour | Class 4-5 | Class 4 | Class 4 | Class 4 | Class 4 |
| Polyester | 1 hour | Class 4-5 | Class 5 | Class 5 | Class 4-5 | Class 3-4 |
| | 16 hour | Class 4-5 | Class 4 | Class 4 | Class 4 | Class 3-4 |
| Fastness to rubbing | | | | | | |
| Dry test | | Class 4 | Class 4 | Class 3-4 | Class 4 | Class 3-4 |
| Wet test | | Class 4 | Class 4 | Class 4 | Class 4 | Class 4 |
| Fastness to light (63° C) | | | | | | |
| 40 hours | | Class 4-5 | Class 5 | Class 4-5 | Class 5 | Class 4 |
| 80 hours | | Class 4 | Class 4-5 | Class 4 | Class 4-5 | Class 4 |
| Flame retardant performance (number of flame touches (n = 5)) | | | | | | |
| Initial | | 4, 4, 5, 4, 4 | 5, 4, 4, 4, 4 | 3, 4, 3, 4, 4 | 4, 4, 4, 4, 4 | 5, 3, 4, 5, 4 |
| After washing | | 4, 4, 5, 4, 5 | 5, 5, 5, 4, 5 | 4, 5, 4, 4, 4 | 4, 5, 4, 4, 4 | 4, 4, 4, 4, 4 |
| After dry cleaning | | 3, 3, 3, 3, 4 | 4, 3, 3, 4, 3 | 3, 4, 3, 3, 4 | 3, 4, 3, 3, 3 | 3, 3, 3, 3, 4 |

TABLE 4

| | | Example 9 | | Comparative Example 5 | |
|---|---|---|---|---|---|
| Flame-retardant processing agent | | F | G | H | I |
| Nonvolatile content (% by weight) | | 40 | 40 | 40 | 40 |
| Flame retardant content (% by weight) | | 36.8 | 36.8 | 36.8 | 36.8 |
| Average particle diameter of flame retardant (μm) | | 0.339 | 0.551 | 0.415 | 6.476 |
| Flame-retardant processing | | | | | |
| Amount of flame-retardant processing agent added (g/L) | | 150 | 150 | 150 | 150 |
| Squeezing ratio (% owf) | | 83.7 | 83.4 | 83.8 | 85.0 |
| Flame retardant-treated cloth | | | | | |
| Amount of attaching flame retardant (% owf) | | 2.4 | 2.0 | 2.3 | 3.3 |
| Feeling | | Good | Good | Good | Slipping |
| Color fastness | | | | | |
| Cotton | 1 hour | Class 5 | Class 4-5 | Class 4-5 | Class 4 |
| | 16 hour | Class 5 | Class 4 | Class 4 | Class 3-4 |
| Polyester | 1 hour | Class 5 | Class 4 | Class 5 | Class 4 |
| | 16 hour | Class 4-5 | Class 4 | Class 4 | Class 3-4 |
| Fastness to rubbing | | | | | |
| Dry test | | Class 4 | Class 4 | Class 3-4 | Class 1 |
| Wet test | | Class 4 | Class 4 | Class 4 | Class 1-2 |
| Fastness to light (63° C.) | | | | | |
| 40 hours | | Class 4 | Class 4 | Class 3-4 | Class 5 |
| 80 hours | | Class 3-4 | Class 3-4 | Class 3 | Class 4-5 |
| Flame retardant performance (number of flame touches (n = 5)) | | | | | |
| Initial | | 5, 4, 4, 5, 4 | 3, 4, 3, 4, 4 | 4, 4, 4, 4, 4 | 3, 4, 3, 3, 3 |
| After washing | | 5, 5, 5, 5, 4 | 4, 3, 3, 4, 3 | 4, 5, 4, 5, 5 | 3, 3, 3, 4, 3 |
| After dry cleaning | | 4, 4, 3, 4, 3 | 3, 3, 4, 4, 3 | 3, 4, 3, 3, 4 | 1, 1, 1, 1, 2 |

The invention claimed is:

1. A method for flame-retardant treatment of a polyester-based fiber product, comprising applying the polyester-based fiber product with a flame-retardant treating agent obtained by mixing a diaryl aminophosphate represented by formula (II):

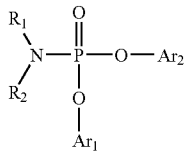

(II)

wherein $Ar_1$ and $Ar_2$ independently denote an aryl group of 6-18 carbon atoms which may have one to three lower alkyl groups of 1-4 carbon atoms, $R_1$, $R_2$ and nitrogen are combined to form an anilino group, with water together with at least one surfactant selected from the group consisting of nonionic surfactants and anionic surfactants, and then milling the diaryl aminophosphate into fine particles having particle diameter in the range of 0.3 to 3 μm, so that the polyester-based fiber product has the diaryl aminophosphate attached thereto in an amount of 0.5 to 2.8% by weight based on the polyester-based fiber product.

2. A method for flame-retardant treatment of a polyester-based fiber product, comprising applying a flame-retardant treating agent obtained by mixing diaryl aminophosphate represented by formula (II):

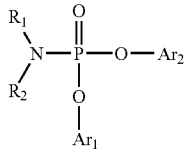

(II)

wherein $Ar_1$ and $Ar_2$ independently denote an aryl group of 6-18 carbon atoms which may have one to three alkyl groups of 1-4 carbon atoms, $R_1$, $R_2$ and nitrogen are combined to form an anilino group, with water together with at least one surfactant selected from the group consisting of nonionic surfactants and anionic surfactants, and then milling the diaryl aminophosphate into fine particles having particle diameter in the range of 0.3 to 3 μm, to the polyester-based fiber product, drying the resultant, and heat-treating the resultant at a temperature from 170 to 220° C., so that the polyester-based fiber product has the diaryl aminophosphate attached thereto in an amount of 0.5 to 2.8% by weight based on the polyester-based fiber product.

3. A method for flame-retardant treatment of a polyester-based fiber product, comprising treating the polyester-based fiber product by an exhaustion method in which the polyester-based fiber product is immersed in a bath containing a flame-retardant treating agent therein and is heated at a temperature from 110 to 140° C. so that the polyester-based fiber product takes up the flame-retardant treating agent therein, the flame-retardant treating agent being obtained by mixing a diaryl aminophosphate represented by formula (II):

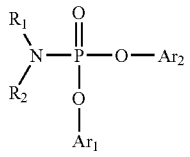

(II)

wherein $Ar_1$ and $Ar_2$ independently denote an aryl group of 6-18 carbon atoms which may have one to three alkyl groups of 1-4 carbon atoms, $R_1$, $R_2$ and nitrogen are combined to form an anilino group, with water together with at least one surfactant selected from the group consisting of nonionic surfactants and anionic surfactants, and then milling the diaryl aminophosphate into fine particles having a particle diameter in the range of 0.3 to 3 μm, so that the polyester-based fiber product has the diaryl aminophosphate attached thereto in an amount of 0.5 to 2.8% by weight based on the polyester-based fiber product.

4. The method according to claim 3 wherein the bath further contains a dispersion dye whereby the polyester-based fiber product is dyed and provided with the diaryl aminophosphate.

5. The method according to claim 1 wherein the aryl group is a phenyl or a cresyl group.

6. The method according to claim 2 wherein the aryl group is a phenyl or a cresyl group.

7. The method according to claim 3 wherein the aryl group is a phenyl or a cresyl group.

* * * * *